US006931727B2

(12) United States Patent
Bulmer et al.

(10) Patent No.: US 6,931,727 B2
(45) Date of Patent: Aug. 23, 2005

(54) METHOD OF CONNECTING MULTI CONDUCTOR CABLE CONNECTOR

(75) Inventors: Douglas R. Bulmer, Windham, NH (US); Joseph A. Roberts, II, Hudson, NH (US)

(73) Assignee: Miraco, Inc., Manchester, NH (US)

( * ) Notice: Subject to any disclaimer, the term of this patent is extended or adjusted under 35 U.S.C. 154(b) by 335 days.

(21) Appl. No.: 10/109,333

(22) Filed: Mar. 28, 2002

(65) Prior Publication Data

US 2002/0160648 A1 Oct. 31, 2002

Related U.S. Application Data

(62) Division of application No. 09/843,317, filed on Apr. 25, 2001, now Pat. No. 6,394,833.

(51) Int. Cl.[7] ..... H01R 43/04

(52) U.S. Cl. ..... 29/882; 29/876; 29/861; 29/857; 29/747; 439/818

(58) Field of Search ..... 29/882, 876, 874, 29/857, 861; 439/393, 496, 814, 495, 417, 404

(56) References Cited

U.S. PATENT DOCUMENTS 4,573,752 A * 3/1986 Rich ..... 339/17 F
5,069,625 A * 12/1991 Brandt ..... 439/404
6,394,833 B1 * 5/2002 Bulmer et al. ..... 439/393
6,711,816 B2 * 3/2004 Tsunematsu ..... 29/882

* cited by examiner

*Primary Examiner*—Minh Trinh
(74) *Attorney, Agent, or Firm*—Devine, Millimet & Branch; Paul C. Remos; Michelle Saquet Temple

(57) ABSTRACT

This invention is an electrical connection method for connecting multiple conductor cable, ideally flat flexible cable. The method involves using an actuator for pressing the cable against multiple contacts in a base, each of which contacts has a sharp edge for removing insulation from the cable.

17 Claims, 16 Drawing Sheets

METHOD OF CONNECTING MULTI CONDUCTOR CABLE CONNECTOR

The present application claims benefit as a divisional application from the previously filed parent application, U.S. patent application Ser. No. 09/843,317, filed Apr. 25, 2001, now U.S. Pat. No. 6,394,833, issued May 28, 2002.

FIELD OF THE INVENTION

This invention relates to the field of electrical connectors. Specifically, this invention relates to the field of electrical connectors for multi-conductor cable.

BACKGROUND OF THE INVENTION

The present invention is an Insulation Displacement Connector (IDC) for use with multi-conductor cable, such as Flat Flexible Cable (FFC) and Flexible Printed Circuits (FPC) which would provide the same convenience, cost savings, and long-term reliability that has been available for solid conductor round wire connections using the "U" form contact for over two decades. The result is a design that successfully translates IDC technology used for round wire interconnects to flat conductor systems.

The "U" form IDC contact was originally developed for the telephone industry to terminate solid and stranded core, round conductor wire. In these connectors, "U" shaped metal contacts are used to both pierce through and displace the insulation to make a gas-tight contact with the underlying conductor(s) of either a single conductor round wire or multi-conductor laminated round wire cable.

Application of an IDC for use with multi-conductor cable can result in a significant cost savings. With current connectors, the conductors of the multi-conductor cable must be exposed in the area that the interconnection will be made. Some connectors require exposure on both sides and others require either the addition of a stiffening film to the backside of the cable in the connector area or holes punched in the cable for positioning and strain relieving. The end user must specify and purchase the multi-conductor cable at specific lengths with the exposed areas either punched or laser cut and the holes either punched or drilled. Each of these operations has a cost and tolerances associated with it. Failure to meet the tolerances will result in rejected product, lost time, and lost money. With an IDC, exposing the conductors before assembly is not required and an assembler can simply use continuous lengths of multi-conductor cable that can be cut to length without any special tooling.

Until now, there have been few applications for this technology for flat conductor cables. Previous IDC connector designs have attempted to translate the technology used for round wire to flat conductor cable but have included severe limitations. FIG. 1 shows an example of an IDC connector attempting to use round wire technology for flat conductor cable connectors.

One such limitation is that the contact pierces through the insulation on both sides of the cable. This limitation has several inherent problems. The first problem is that the insulation distance or "spacing" between the conductors has been decreased. A decrease in spacing will reduce the high-voltage carrying capacity of the system and may cause short circuiting failures. The second problem is that piercing through the insulation weakens it, and may cause it to tear and expose an air gap between adjacent conductors, also decreasing the high-voltage carrying capacity of the system. This problem would especially cause concern when using polyimide insulation materials, which have a lower tear resistance than polyester materials.

Another problem emerges when the copper conductor is folded during the engagement of the contact and the conductor. Since copper is a ductile material, it does not provide enough spring resistance and will create an unreliable electrical contact as the copper relaxes over time and reduces the contact pressure at the connection point. Also, if the conductor does not fold, it will be either damaged or broken. Also, its current carrying capacity will be decreased.

A large part of the IDC market for flat conductor cable is the crimped-on contact style. This connection system uses contacts, which are individually crimped onto the conductors of the FFC/FPC and then may be inserted into a connector housing or soldered directly to a PCB. There are various designs for this type of contact. One of these types pierces through both the insulation and the copper conductor, which damages the conductor and reduces its current carrying capacity. Another design pierces through the insulation between the conductors and wraps around the conductor to provide pressure against small lances that pierce the insulation to make contact with the conductor. FIG. 2 shows this type of crimped-on contact.

As previously described, the piercing of the insulation both reduces the spacing between conductors and weakens the insulation, which may tear. Both of these designs rely on the forming of the crimped contact to provide the spring force necessary to maintain a gas-tight electrical contact. If the crimping process is not performed properly and consistently, the contact system will be unreliable. Also, this type of connection leaves the conductive material of the contact exposed on the outside of the cable with only an air gap to provide electrical insulation between the conductors, limiting the high-voltage carrying capacity of the system.

A fourth problem is that in many of these designs the contacts either intentionally or unintentionally may pierce through both the protective surface plating and copper conductors of the multi-conductor cable. Motion at the connection points may expose this copper to the environment and copper oxides may form which will propagate and eventually contaminate the connection causing a short or open circuit failure.

With all of the above-described designs, the conductor density is severely limited due to the space required to provide a contact that is sufficiently strong to provide the minimum contact force for a gas-tight connection. Many of these designs require a large spacing between the conductors and are not capable of being used in newer system designs, which require much higher density connectors.

Finally, previous IDC designs for multi-conductor cables always provided minimal contact area. The various IDC designs either piercing or bending the conductors used the side of the conductors to establish a contact area. Since the conductors in multi-conductor cables are generally flat, meaning the conductors are wider than they are deep, using the side of the conductor to establish a contact area reduces the prospective size of the contact area. A better IDC design would use the wide portion of the conductors thereby increasing contact area. Increased contact area means increased current flow capacity. Also, the multi-conductor cable density is impaired by the required piercing of insulation between conductors instead of making contact with the conductors on their wider surface.

SUMMARY OF THE INVENTION

This invention results from the realization that an IDC can be made more compact than previously available connectors by using a more narrow contact for each conductor in the multi-conductor cable, can be made more convenient by enabling all conductors contained in the multi-conductor cable to be connected with a single user motion, and can connect to multi-conductor cable without damaging the mechanical or electrical integrity of the cable conductors.

It is therefore an object of this invention that all conductors in the multi-conductor cable make contact with the invention in a single user motion.

It is a further object of this invention to provide an IDC that will connect multi-conductor cable without causing excessive mechanical damage to the multi-conductor cable conductors.

It is a further object of this invention to provide an IDC that will connect multi-conductor cable without impairing the conductance of the multi-conductor cable conductors.

It is a further object of this invention to provide an IDC that will connect to multi-conductor cable without requiring complete removal of insulation around the conductors.

It is a further object of this invention to provide an IDC that can connect at any location along the cable.

It is a further object of this invention to provide an IDC that can be used without any special preparation of the cable.

It is a further object of this invention to provide an IDC that preserves the spacing between multi-conductor cable conductors.

It is a further object of this invention to provide an IDC that automatically relieves cable strain.

It is a further object of this invention to provide an IDC that maintains sufficient contact pressure over time for a gas-tight connection after full engagement is achieved It is a further object of this invention to provide an IDC that contacts the wider surface of the conductors to increase current carrying capacity.

DETAILED DESCRIPTION OF THE INVENTION

Figure 1:
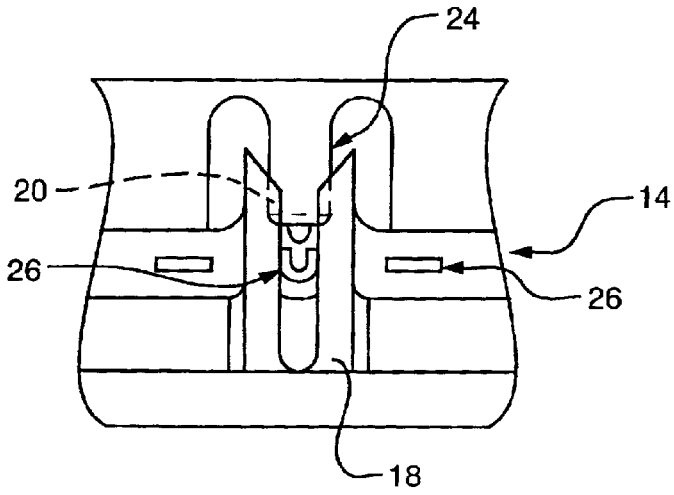
FIG. 1 (PRIOR ART)
FIG. 1 shows the cross-section of a traditional insulation displacement connector, available in the prior art, as applied to flat flexible cable.
Figure 2:
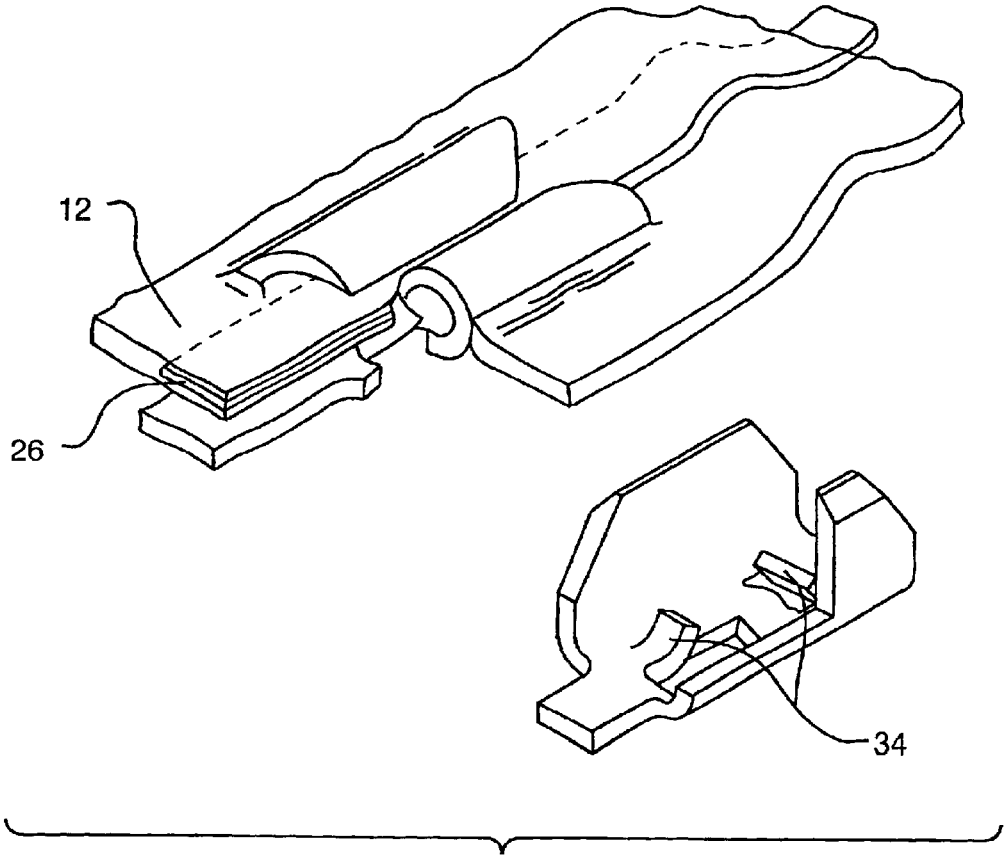
FIG. 2 (PRIOR ART)
FIG. 2 shows a crimped-on contact from the prior art.
Figure 3:
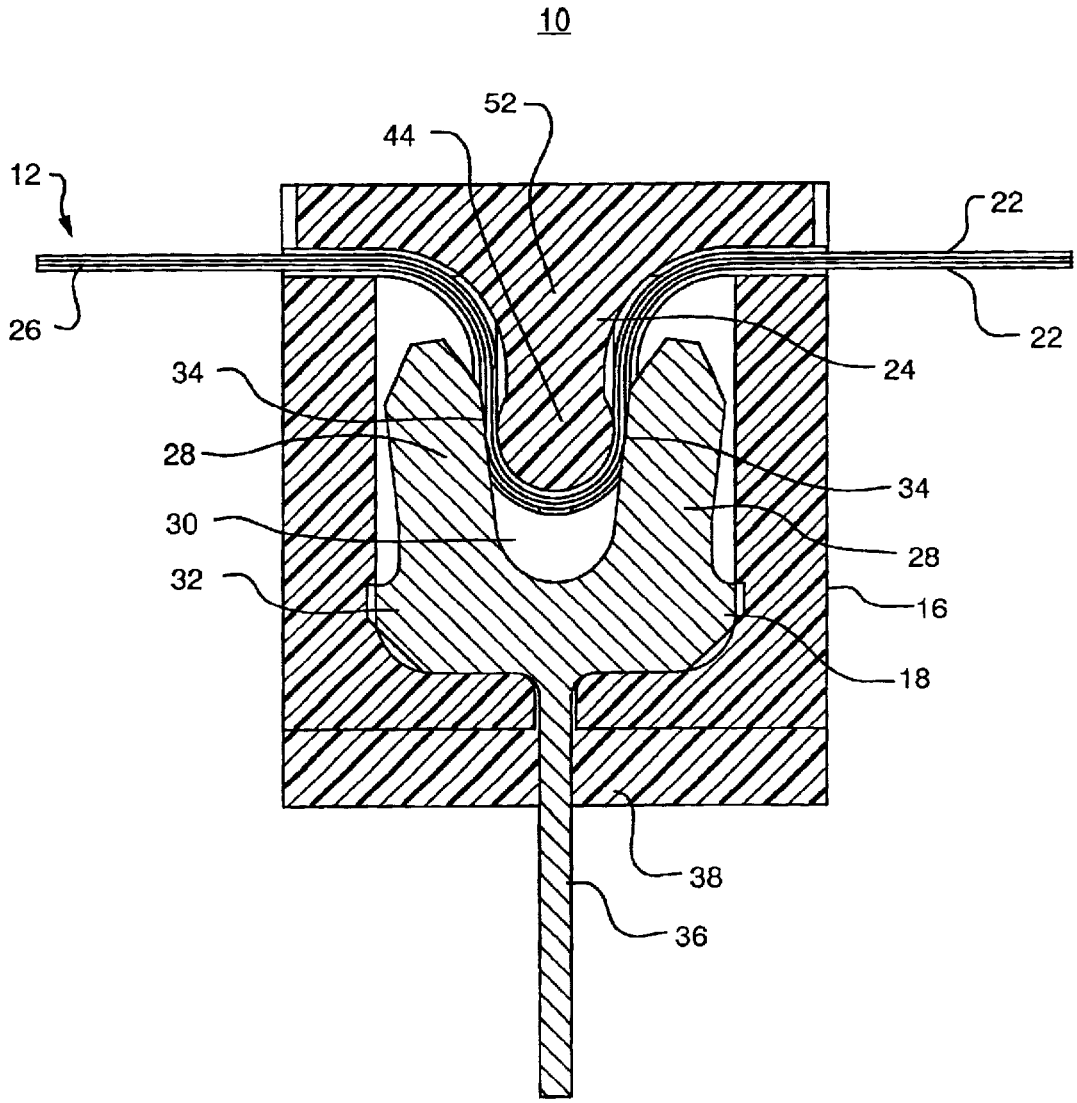
FIG. 3 shows a cross-section of a basic embodiment of this connector.
Figure 4:
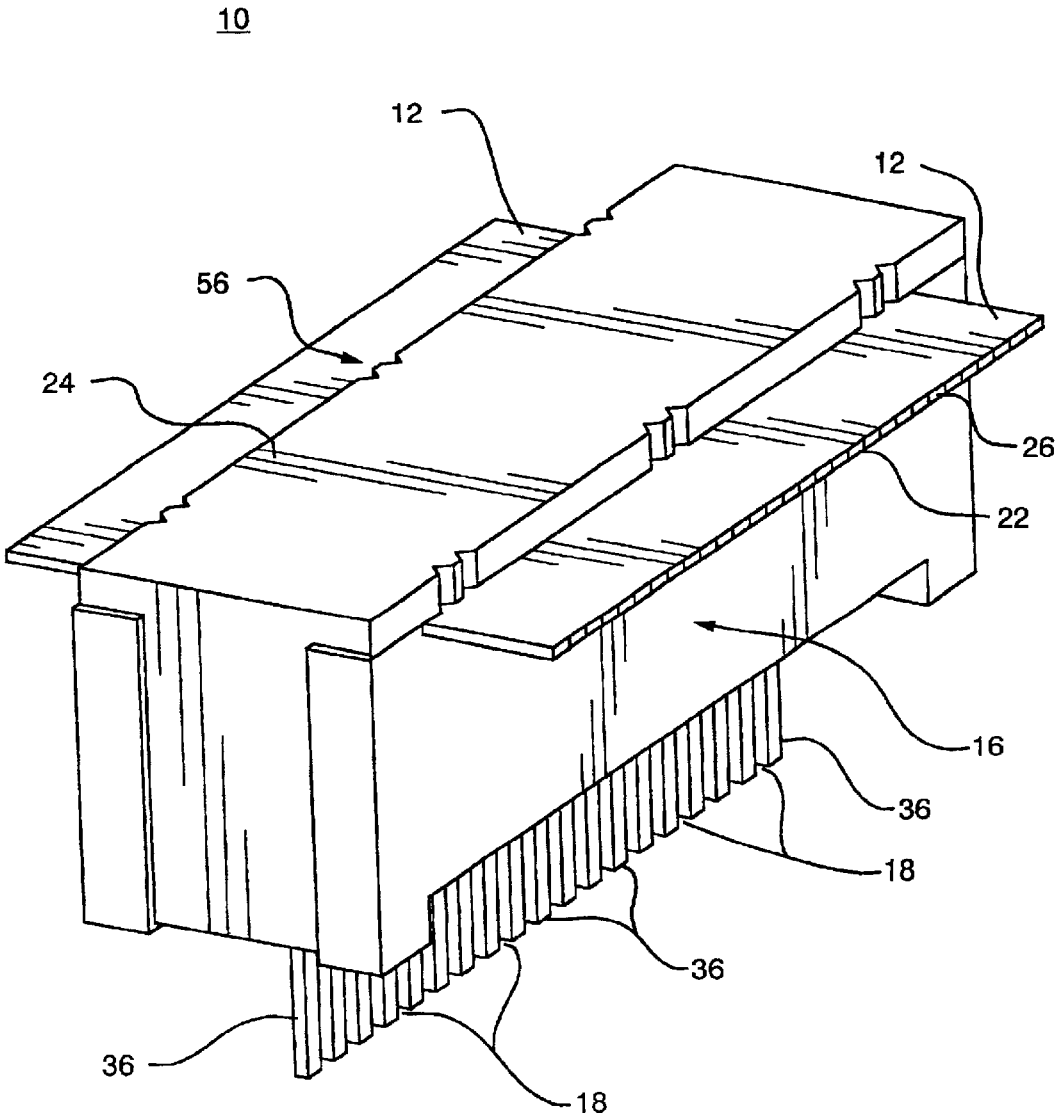
FIG. 4 is a three-dimensional image of the connector.
Figure 5:
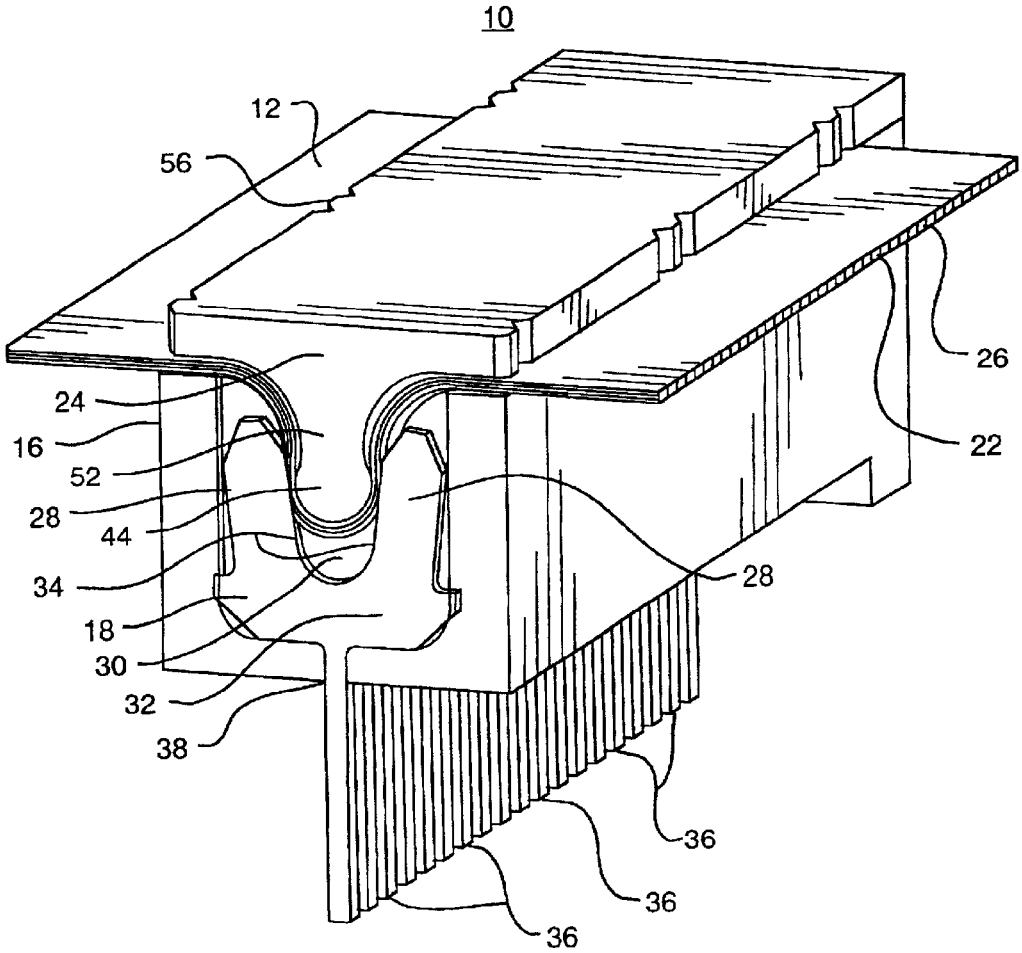
FIG. 5 is another three-dimensional image of connector in FIG. 4 with one end of the connector removed to enable viewing of the connector interior.

This invention is an electrical connector 10, shown in FIG. 3, for connecting multi-conductor cable 12. Multi-conductor cable 12 is cable such as flat flexible cable, printed circuits, and similarly constructed cables wherein the cross-section of the conductor 26 has a width dimension 13 greater than the thickness dimension 14. The surface of each conductor 26. The inventive electrical connector 10 has a base 16 for holding multiple contacts 18. The contacts 18 should be positioned substantially in parallel with each other and are located at least partially within the base 16 of the electrical connector 10. Each contact 18 has at least one insulation-displacing surface 34. The insulation-displacing surface 34 is preferably a part of the contact 18 and is oriented to remove insulation 22 from along the width dimension 13 of the conductors 26, described as a width surface 15. The final part of the electrical connector 10, in one of its broadest embodiments, is an actuator 24, interlockable with the base 16, for pressing the multi-conductor cable 12 against the multiple contacts 18 and, specifically, for pressing the width surface 15 of each of the conductors 26 against the insulation-displacing surface 34 of the contacts 18.

By pressing the multi-conductor cable 12 against the contacts 18 and, thereby, insulation-displacing surface 34, when joining the actuator 24 with the base 16, the force and friction between the multi-conductor cable 12 and insulation-displacing surface 34 removes the insulation 22 from each of the conductors 26 along the width surface 15. As the actuator 24 interlocks with the base 16, the conductors 26 are pressed and held against the contacts 18, thereby making an electrical connection. A second set of conductors is connected, by any of a multitude of means readily discernable by those skilled in the art and therefore not a part of this invention, to the contacts 18 and, when the base 16 and actuator 24 are joined, the electrical circuit with the multi-conductor cable 12 is completed.

This design is similar to an electrical connector for a single conductor cable, which exists in the prior art. For the single conductor IDC, insulation-displacing surface 34 and contacts 18 run perpendicular to the conductor 26. The inventive connector 10 claimed herein essentially rotates the conductor 26 ninety degrees with respect to the connector 10. As a result, the contacts 18 run parallel to the path of the conductors 26, facilitating multiple conductor connection in a minimal amount of space.

A slight modification in the design can be made by causing the insulation-displacing surface 34 to protrude from at least one of the extensions 28. This modification creates a cutting edge 20 and alters the dynamic of the contact 18, although the inventive concept of the invention 10 remains unchanged.

Figure 6:
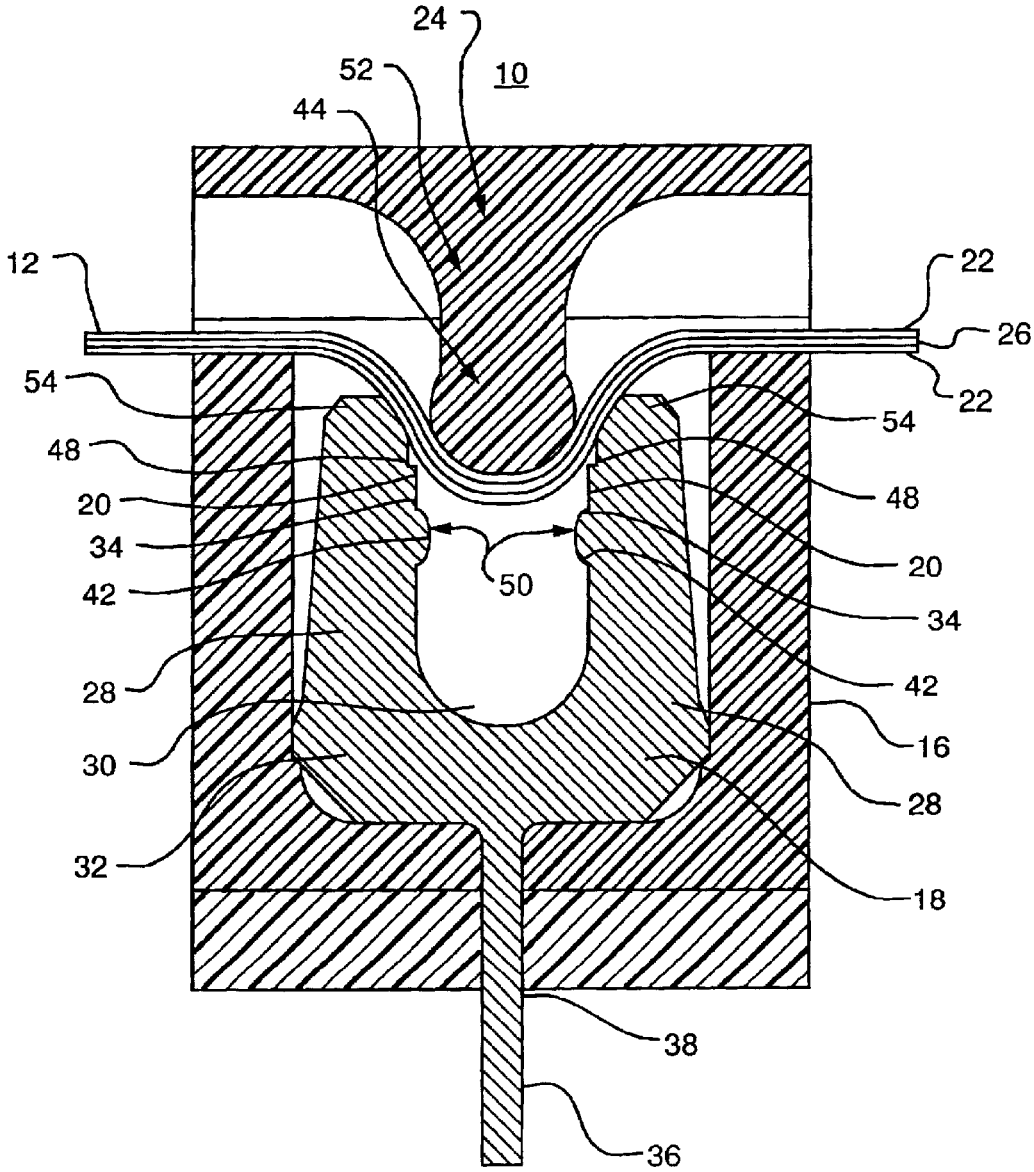
FIG. 6 is another cross-sectional image of another embodiment of the electrical connector.

A narrower concept of the invention involves having the shape of each of the contacts 18 represented by two extensions 28 extruding at least partially in the same direction with a trough 30 between them. A crossbar 32 connects the extensions 28. Then, at least one insulation-displacing surface 34 is located on at least one extension 28, oriented to remove insulation 22 from the width surface 15 of at least one conductor 26. The resulting shape of the contact 18 is similar to that of a tuning fork. A further narrowing of this concept of the invention 10, shown in FIG. 6, involves locating at least one force concentrator 42 on each of the extensions 28. The contacts 18 would be designed such that when the actuator 24 presses the multi-conductor cable 12 into the base 16 and against the force concentrator 42, the extensions 28 will be moved outwardly widening the trough 30 and reducing friction applied by the actuator 24 against the insulation-displacing surfaces 34. The force concentrator 42 lifts the insulation-displacing surface 34 off of the cable 12 to avoid exposing too much of the conductors 26 and also to prevent the insulation-displacing surfaces 34 from rubbing on the conductors 26 at full engagement. The point of full engagement is herein described as the point at which the actuator 24 has been forced into the base 16 to its maximum depth such that the insulation-displacing surfaces 34 on the contacts 18 are in stable electrical contact with the conductors of the cable 12. The force concentrator 42, in one embodiment, contains at least two bumps 50 on at least one of the extensions 28, whereby the first bump 50 to make contact with a conductor 26 wipes remaining adhesive and oxidation from the conductor 26 and the remaining bump(s) 50 are used for maintaining electrical contact with the conductor 26.

Figure 14:
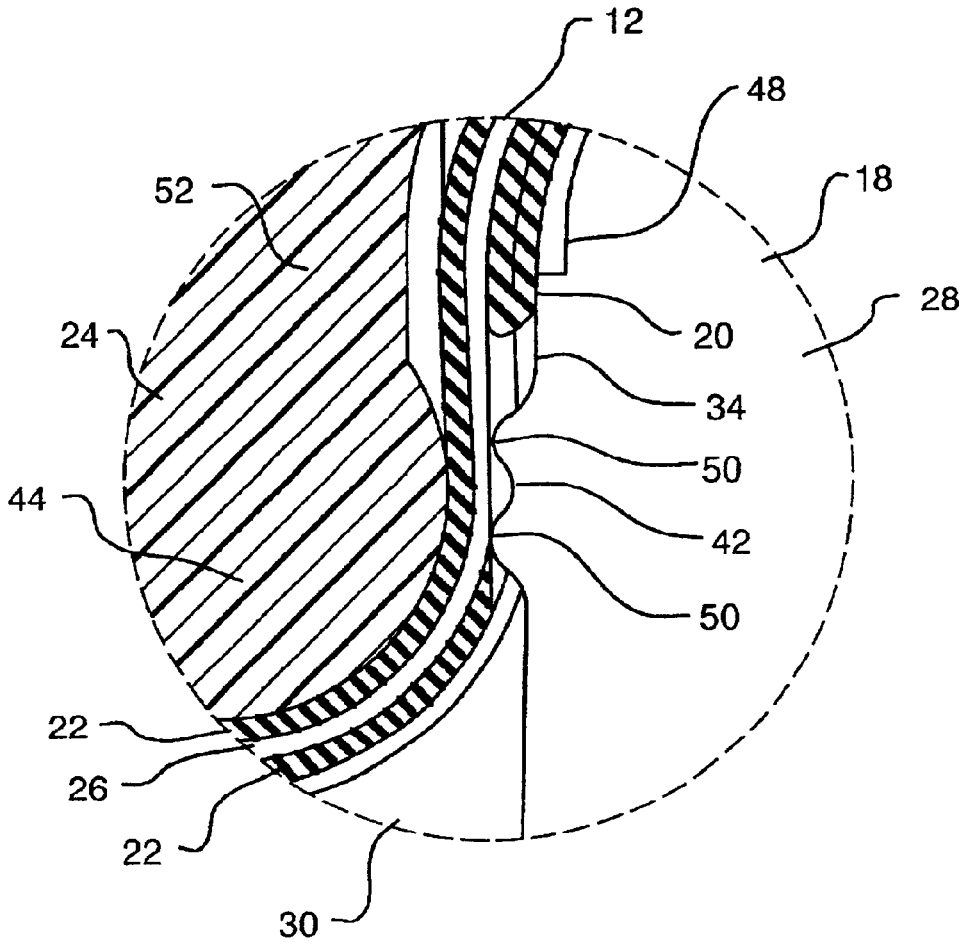
FIG. 14 is a blown-up view of the image in FIG. 13, to amplify the multiple bump design.
Figure 15:
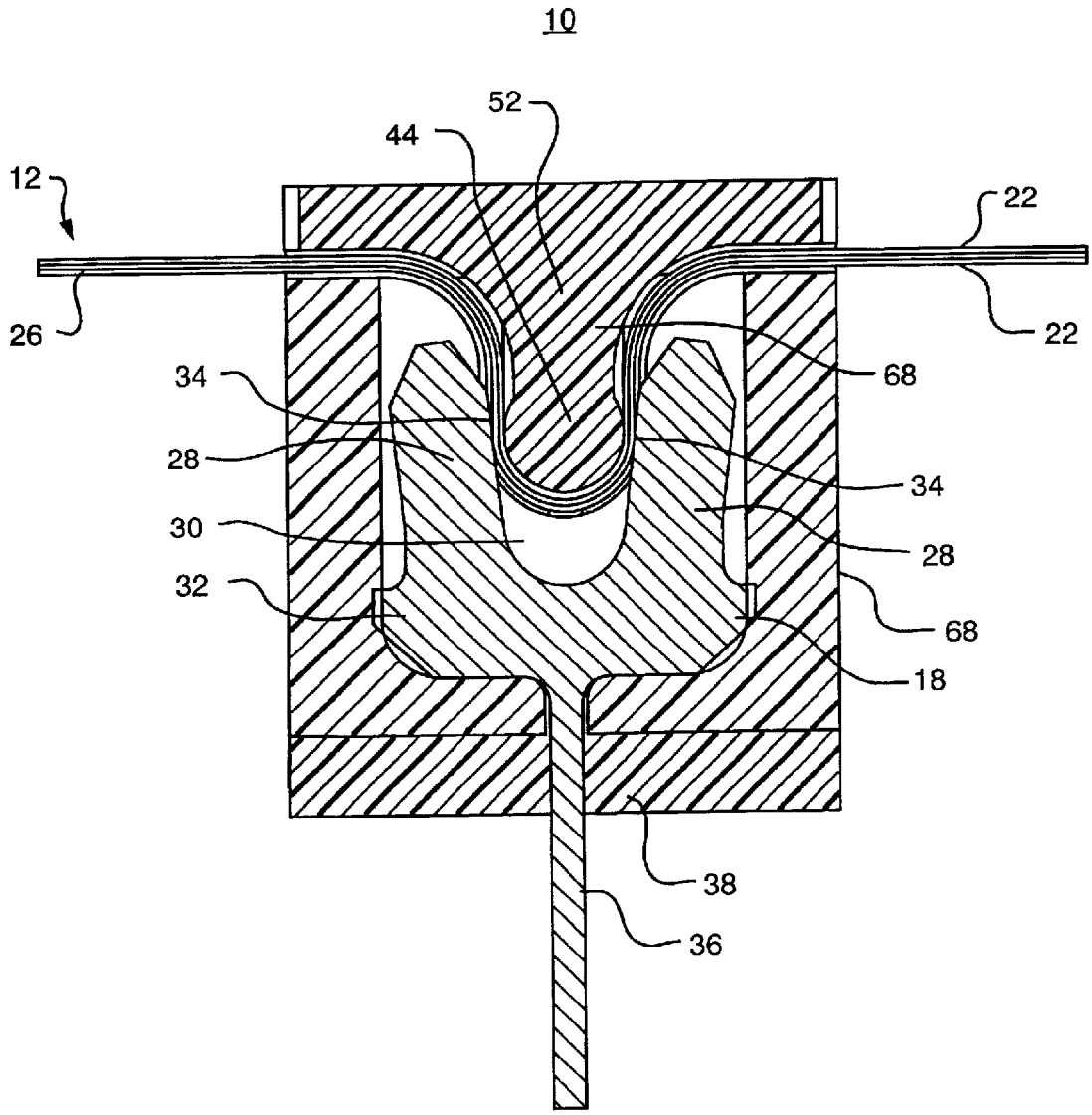
FIG. 15 is a cross-sectional view of another embodiment of the invention.
Figure 16:
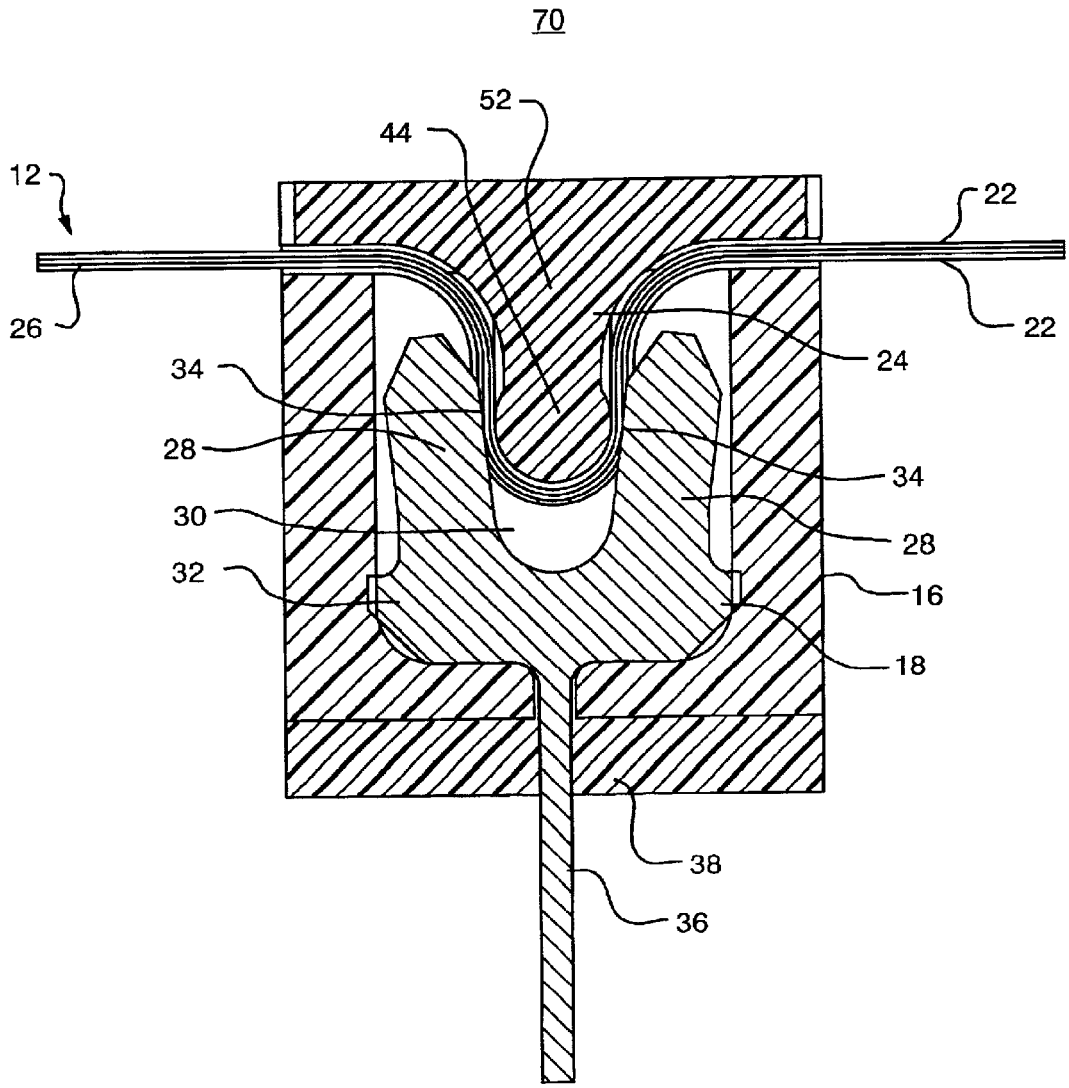
FIG. 16 is a cross-sectional view of another embodiment of the invention.
Figure 17:
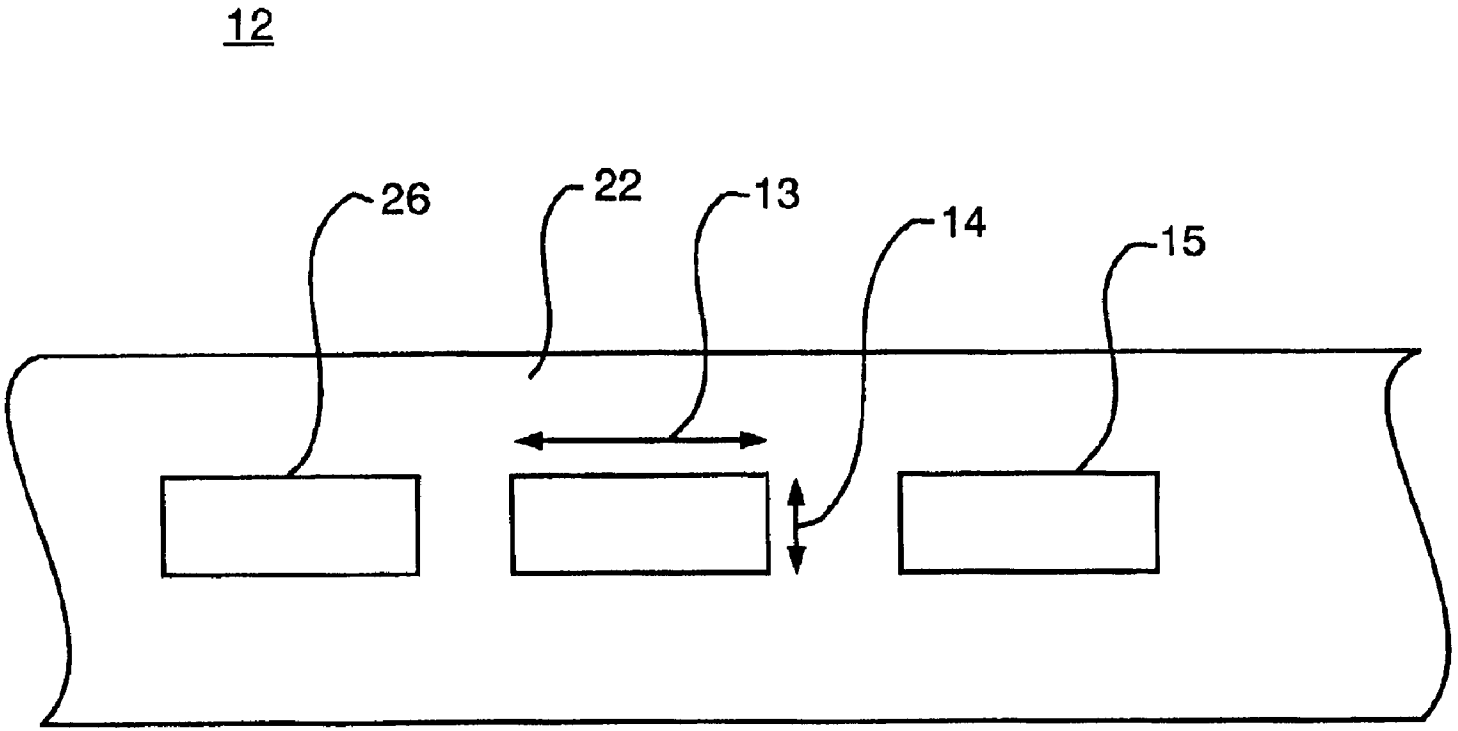
FIG. 17 is a cross-sectional view of the multi-conductor cable.

The connector 10 further contains a depth-limiting feature to mechanically correct for thicker multi-conductor cable 12 and prevent the insulation-displacing surfaces 34 from cutting too deeply into the multi-conductor cable 12, thereby damaging the conductors 26. The depth-limiting feature is a combination of the force concentrator 42, the lead-in radius at the cable forming guide 54 and the depth limiter 48, which is a level of protrusion of the cutting edge 20 from the extension 28, as shown in FIG. 14.

Another narrower concept of the invention requires cross-section of the barrel 44 of the actuator 24 to be shaped similarly to the trough 30, as shown in FIG. 3, to snugly fit within the trough 30 of the contact 18 and maximize sliding friction pressure of the multi-conductor cable 12 against the insulation-displacing surfaces 34.

Another element, which could be added to the invention, is to make the electrical connector 10 base 16 slotted for connection to a male, pinned electrical connector. Alternatively, with the base 16 slotted, a post 36 could extend from the crossbar 32 of each contact 28, through the slots 38 in the base 16 to connect to a female connector or directly to multi-conductor cable 12.

Figure 7:
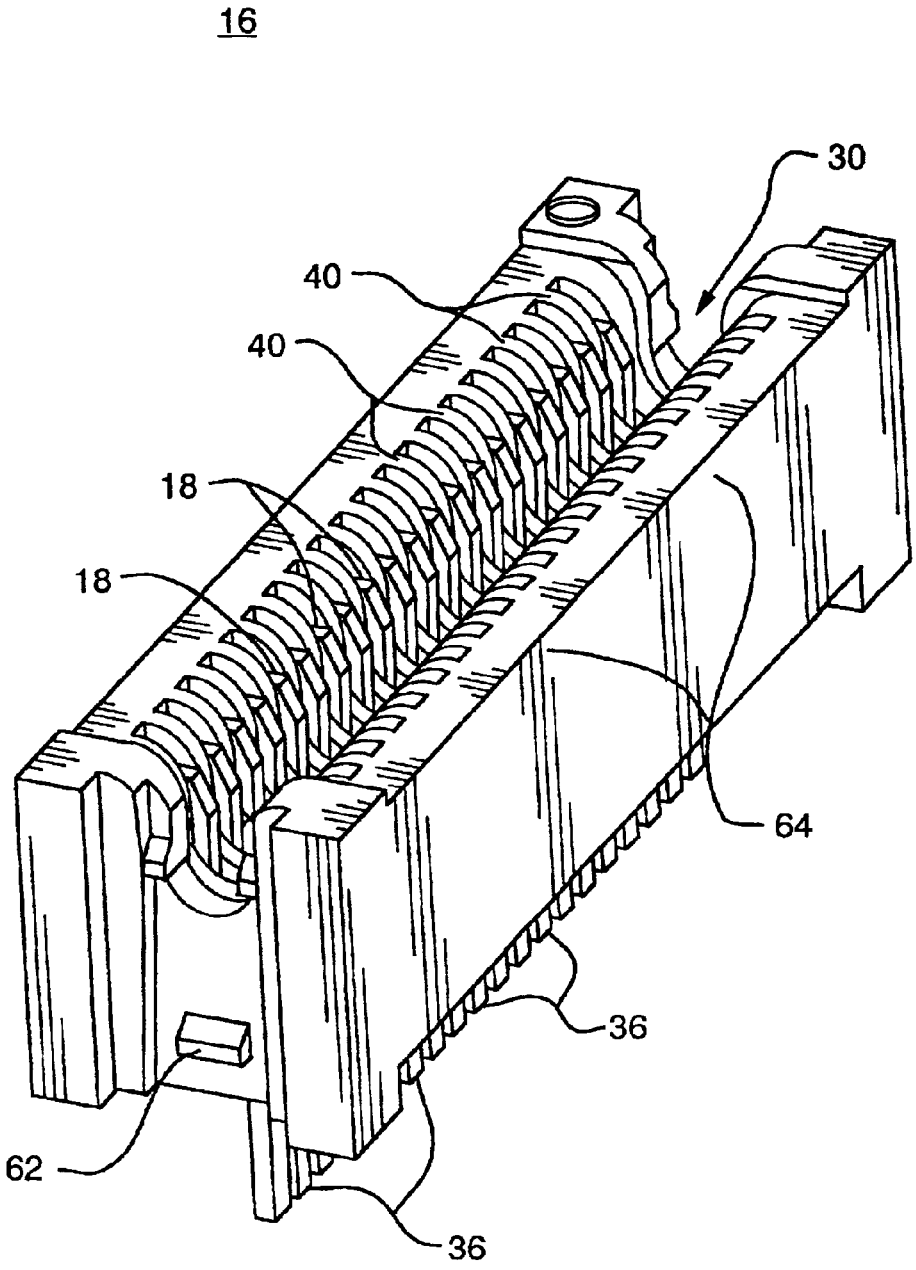
FIG. 7 is three-dimensional image of one embodiment of the base of the electrical connector.
Figure 8:
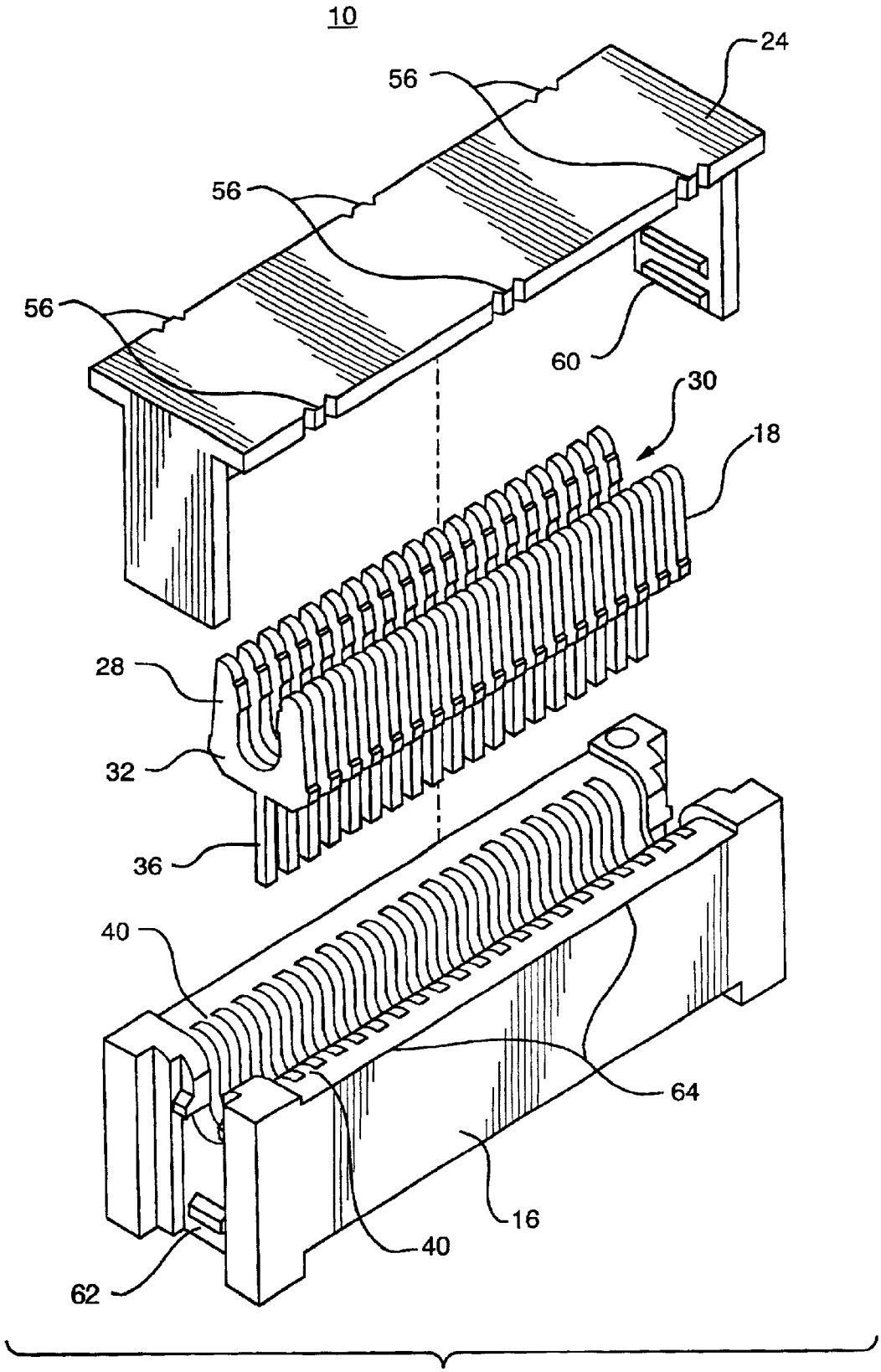
FIG. 8 is an exploded three-dimensional view of one embodiment of the connector.

Another narrower concept of the invention involves having at least one insulating divider 40, shown in FIG. 7, located at least partially between a pair of contacts 18 within the base 16. The insulating dividers 40 can also be used to position the contacts 18 at intervals to match the conductor 26 spacing of the multi-conductor cable 12. One embodiment of the insulating divider 40 is to make the dividers 40 bondable to the contacts 18 to create a laminated contact structure.

There are also a number of embodiment variations for the actuator 24. In one embodiment the actuator 24 is composed of an actuator barrel 44 and an actuator neck 52 wherein the neck 52 is narrower than the barrel 44. This actuator 24 design prevents the insulation-displacing surfaces 34 from removing insulation 22 when the actuator 24 becomes fully engaged because the insulation-displacing surfaces 34 and neck 52 provide insufficient opposing force to cause insulation 22 removal. This relief of pressure against the insulation-displacing surfaces 34 allows all of the pressure to be focused between the width surface 15 of the conductors 26, through the barrel 44, and the force concentrators 42, the intended point of electrical contact for this connector 10, optimizing conductance. Conductance herein is understood to be the inverse of resistance. The narrow neck 52 also provides a location for cut and displaced insulation 22 to accumulate. Directing peeled insulation 22 into this narrow neck 52 area prevents it from interfering with the electrical contact area or pushing back the extension 28.

Another actuator 24 embodiment involves making the actuator 24 slidably interlockable with the base 16. By enabling the actuator 24 to slide, the actuator 24 may be disengaged from the base 16 to allow relocating the connector 10 to a different part of the cable 12 and reengaging the connector 10 to the cable 12 without completely separating the actuator 24 and base 16. A similar embodiment of the actuator 24 allows the actuator 24 to interlock with the base 16 in multiple positions, one of which leaves a sufficient gap between the actuator 24 and base 16 so as to allow the cable 12 to be inserted between the actuator 24 and base 16.

The actuator 24 may also be designed from a material, which is compressible within the range of force that can be applied by the contacts 18. The affect of this design is to allow the actuator 24 to reduce the level of pressure applied to the cable 12 and contacts 28 when it reaches a level that could damage the conductors 26.

In any of the suggested embodiments, the actuator 24 and trough 30 could also be chamfered or rounded, to make it easier for the cable 12 to be pressed tightly against the contacts 18.

Alternative Embodiments

This patent discloses the design for an improved Insulation Displacement Connector 10 for electrically terminating multi-conductor cable 12, Printed Circuit Boards (PCB) and similar electronic devices. The connector 10 consists of an electrically insulating molded plastic base 16 that houses an array of stamped planar metal contacts 18 placed parallel to one another and separated by electrically insulating dividers 40.

Figure 9:
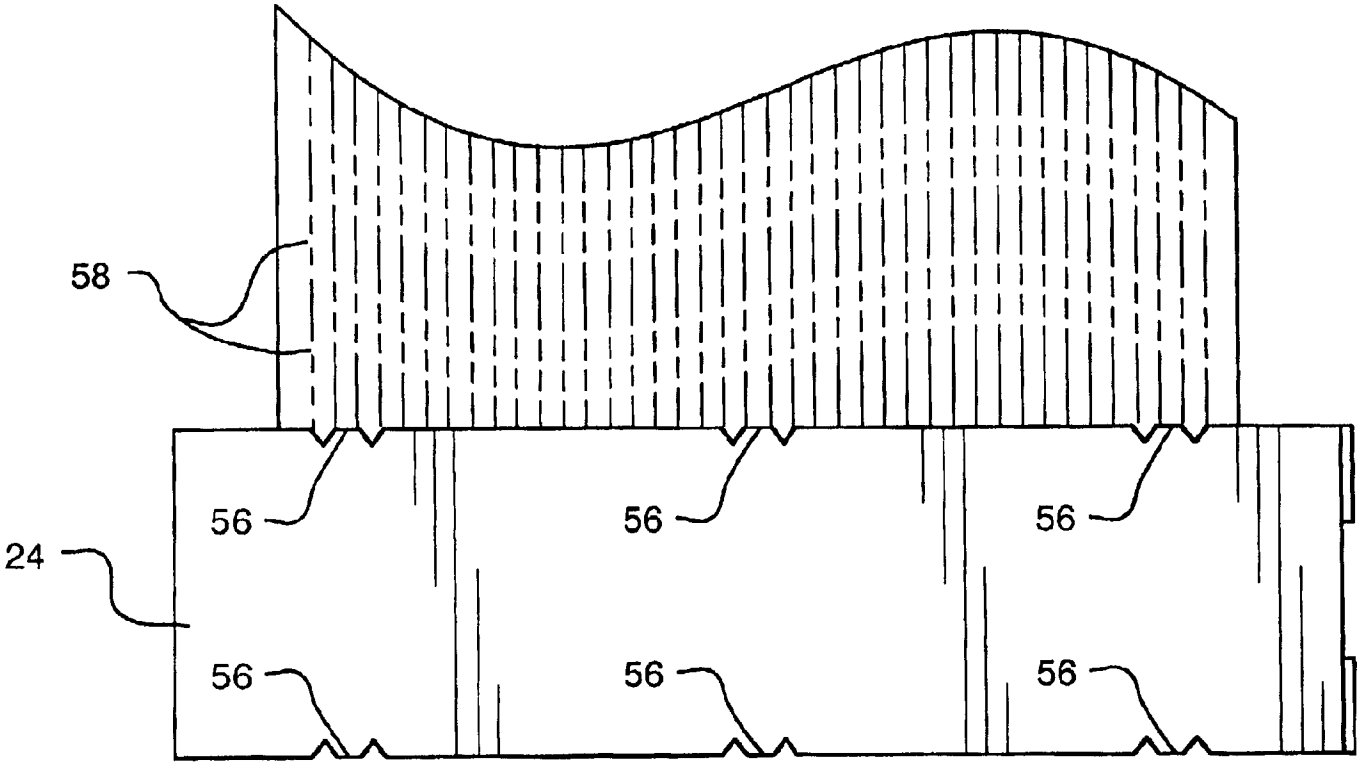
FIG. 9 is an overhead view of the connector, displaying use of the notches in the actuator.
Figure 10:
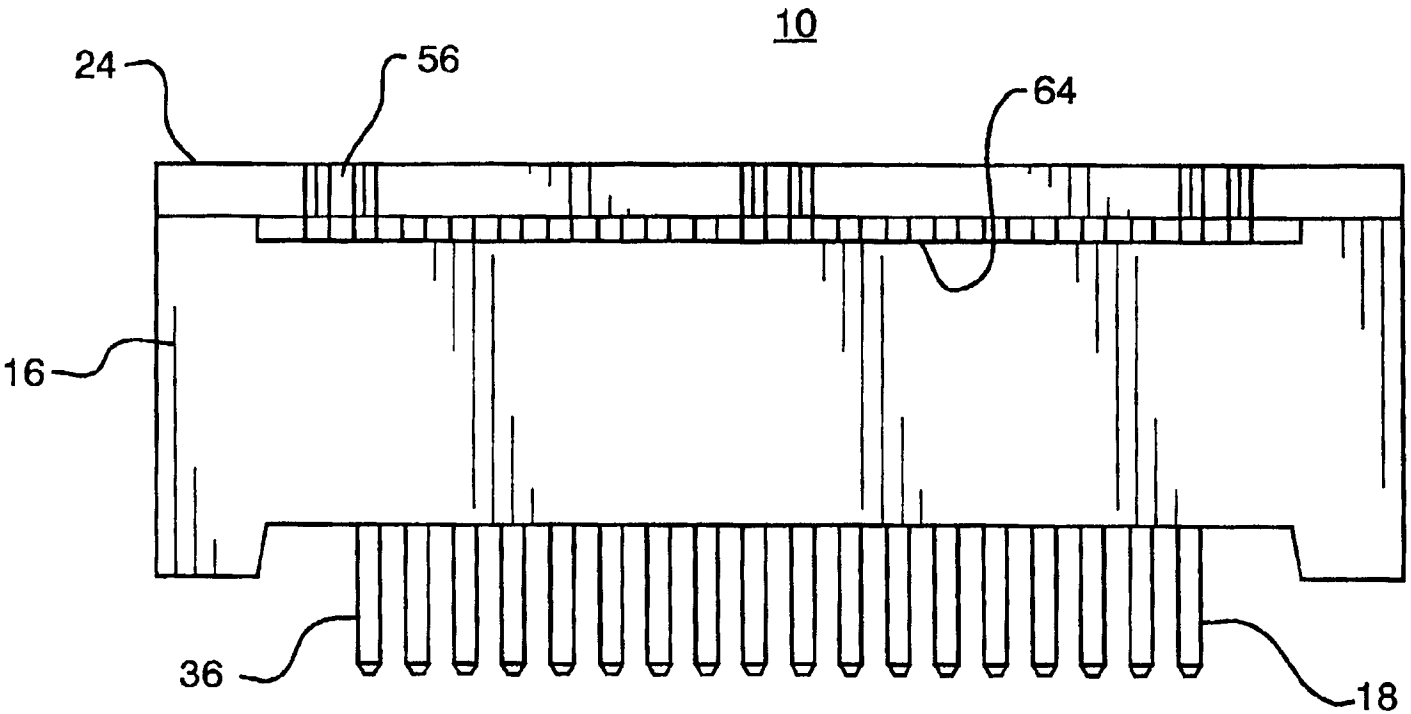
FIG. 10 is a side view of the connector.

The planar contacts 18 are oriented perpendicular to the length of the connector base 16, which places them parallel to the conductors 26 of a cable 12 inserted into the connector 10. An electrically insulating molded plastic actuator 24 slidably attaches to the base 16 in a raised position to allow the cable 12 to be inserted. The cable 12 is accurately aligned by means of a recessed slot 64 in the base 16 sized to the width of the cable 12, which guides the edges of the cable 12. The cable 12 may be more precisely aligned by accurately punching one or more registration holes 58, shown in FIG. 9, in the space between the conductors 26, which will mate to pins molded on the actuator 24. Visual alignment notches 56 provided along the outside of the actuator 24 provide visual alignment verification for inspection purposes after assembly. Once the cable 12 is inserted into the connector 10, the actuator 24 is forced into the base 16 by means of a parallel action tool such as a small arbor press or vise, although conceivably the shape of the actuator 24 barrel 44 could be altered to reduce the force required to engage the connector 10.

Forcing the actuator 24 into the base 16, wraps the cable 12 around the barrel 44 of the actuator 24, forcing the conductors 26 of the cable 12 to simulate a solid core round wire and relieving cable strain. The insertion of the actuator 24 into the base 16 causes the multi-conductor cable 12 to be forced into the contacts 18. As the contacts 18 are engaged, they pierce through and peel off the insulation 22 of the cable 12 to make an electrical connection. The actuator 24 locks in place at the full engagement point by means of molded-in snap locks 60 and 62.

The contacts 18 are Integrated 3 Stage Contacts. The contacts 18 have a cable forming guide 54 and depth limiter 48, which forces the cable 12 to tightly wrap around the barrel 44 of the actuator and 24 deflects the extensions 28 of the contact 18 to compensate for variations in material thickness so that the cutting edge 20 is correctly positioned to pierce the insulation 22 without damaging the conductors 26 of the cable 12. The contacts 18 are designed such that they do not penetrate through the protective plating of the conductors 26 to the copper underneath so that copper oxidation growth is not a problem. The contacts also have a cutting edge 20 that both pierces through the insulation 22 and adhesive of the cable 12 and peels them back to expose the conductors 26 without damaging them. Finally, the contacts 18 have a force concentrator 42 that both lifts the cutting edge 20 away from the cable 12 to prevent exposing too much of the conductor 26 and deflects the extension 28 sufficiently to provide the force required to make a gas-tight connection. The contact 18 design can use either a single extension, which would allow for increased density of the system, or a double extension, which would put a cutting edge 20 on either side of the barrel 44 for each conductor 26. Density of the system is defined by the number of contacts 18 or conductors 26 per inch of the cable 12 width.

Figure 13:
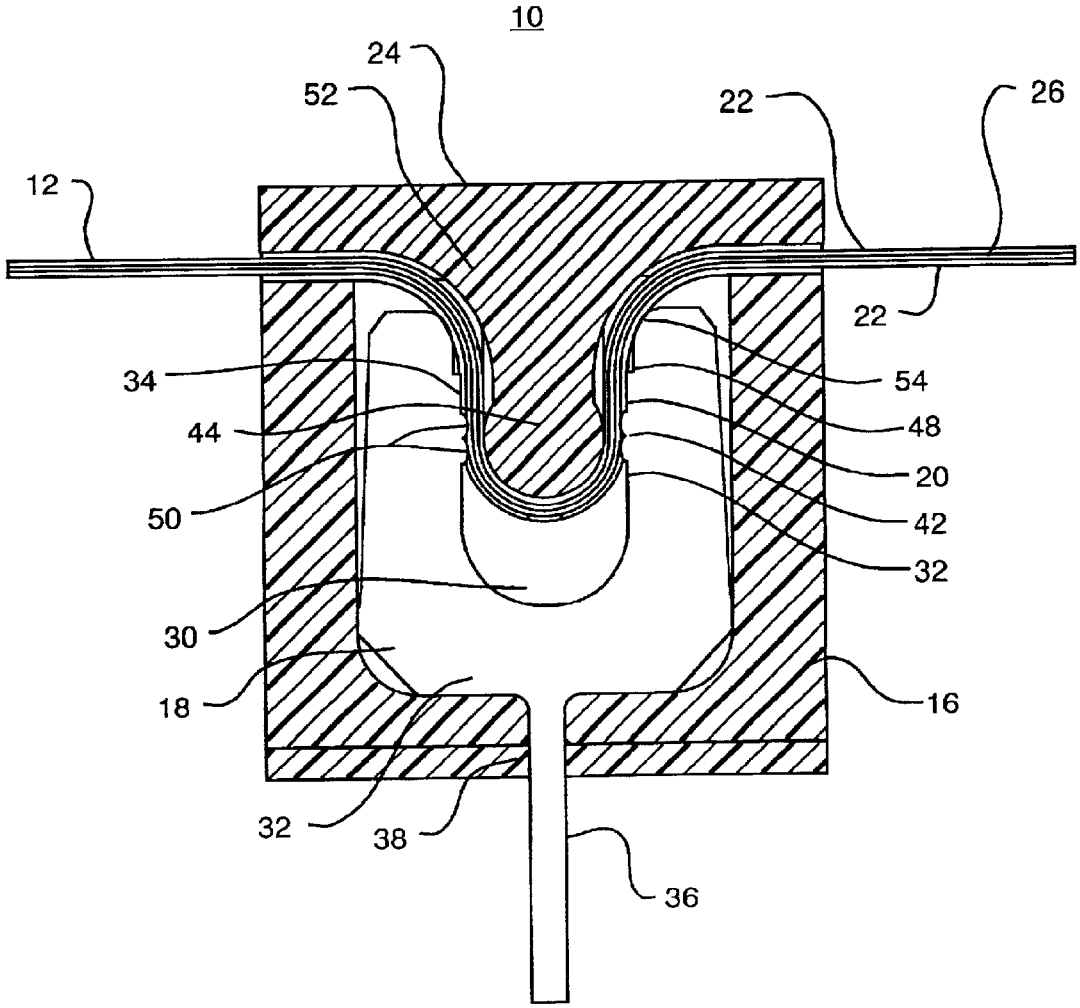
FIG. 13 is a cross-sectional image of another embodiment of this invention, in which a multiple bump design is used for the force concentrator.

The force concentrator 42 can be of a single or multiple bump 50 design. The multiple bump 50 design, shown in FIGS. 13 and 14, provides added benefits. First, the first bump 50 clears away any remaining adhesive and any plating oxidation on the conductor 26 to allow the additional bumps 50 to make a cleaner contact. Second, the multiple bump 50 design provides redundant connection points for greater reliability and increasing the surface area of the connection points for higher current carrying capacity. Finally, as shown in FIG. 14, the centering of the bumps 50 on the barrel 44 of the actuator 24 effectively locks it onto the actuator 24 for greater stability of the connection under vibration.

The contacts 18 pierce and peel away the insulation 22 of the multi-conductor cable 12 in such a way that the insulation 22 between the conductors 26 remains. Disruption or removal of this insulation 22 between the conductors 26 would leave only an air gap for electrical resistance between the conductors 26 of the circuit and thus reducing the high-voltage resistance of the system. Leaving the insulation 22 between the conductors 26 also allows the multi-conductor cable 12 to retain more of its tensile strength to prevent conductor 26 breakage during engagement due to the force required to pierce and peel insulation 22. A partial seal may be created around the connection points by applying heat to the contacts 18, which will cause the adhesive within the cable 12 to melt and flow around the connection.

The contacts 18 are also designed to be free-floating within the connector base 16 so that they may self-align to the cable 12 and actuator 24 as the system is engaged. This ensures that the contact pressure will be equally distributed at the two connection points made between the contacts 18 and each conductor 26. Also, the contacts 18 are of a potential energy type that will maintain the minimum contact pressure required for a gas-tight contact over time even with stress relaxation or creep of the materials.

The actuator 24 serves several functions in the connector 10. It helps simulate the way a traditional round wire IDC works and strain relieves the cable 12. Strain relief is accomplished by isolating the electrical contact area from the length of cable 12 that extends from the connector 10 such that any motion or strain applied to the free end of the cable 12 does not affect the stability of the electrical contact between the contacts 18 and the conductors 26 of the cable 12.

By wrapping the multi-conductor cable 12 around the rounded barrel 44 of the actuator 24, it is possible to accurately simulate a solid core round wire. In round wire applications, the copper core of the wire is plastically deformed to a more oblong shape when it is inserted into the contact 18. The deformation increases the amount of contact area between the "U" shaped contact 18 and the copper conductor 26. It is generally recommended that the contact area be a minimum of twice the cross-sectional area of the copper conductor 26. In the proposed connector 10 design, both the backing insulation 22 and the plastic actuator 24 can compress slightly to mimic the distortion of a round conductor 26 wire to achieve the needed contact area.

Wrapping the cable 12 around the actuator 24 and engaging it automatically strain relieves the circuit. This will prevent the cable 12 from being able to be pulled out of the connector 10 and prevents vibration or movement of the cable 12 from causing any discontinuity in the electrical connection under vibration conditions. The cable forming guide 54 of each extension 28 can be chamfered to optimize engagement between the cable 12 and the barrel 44 of the actuator 24, improve positioning of the cable 12 and prevent lifting of the top dielectric. It is understood that chamfering means radiusing, rounding or any other action that reduces angular corners in items such as the cable forming guide 54.

When the connector 10 is fully engaged, the cable 12 fits closely against the inner profile of the base 16. This inner profile is made up of electrically insulating "fins" or insulating dividers 40 which separate the contacts. This system effectively isolates each of the contacts 18 and their connection points so that there are no air-gaps, which would cause high voltage arcing failures. Also, the contacts 18 do not violate the spacing between the conductors 26 and do not require any more space than the conductors 26 themselves so that much higher conductor 26 densities can be achieved. This is partly due to the fact that there are no size limitations placed on the contacts 18 other than that of the material thickness.

Even greater conductor 26 densities can be achieved by using a laminated contact 18 structure where an electrically insulating film is laminated between the contacts 18 in place of the insulation dividers 40 of the base 16. With this technology, conductor 26 pitches smaller than 0.010 inch can be achieved. Pitch is herein defined as the centerline distance between adjacent conductors 26. Conductor 26 densities can also be increased by using a multiple actuator 24 system and staggering the contacts 18 on the multiple actuators 24.

The design of this connector 10 allows the cable 12 to pass completely through so that the connector 10 can be placed at any position along the length of the cable 12. This makes it possible to build a "jumper" cable assembly for interconnecting multiple devices using a single cable. This connector 10 can be designed as a male or female connector without departing from the principles of the invention.

Figure 11:
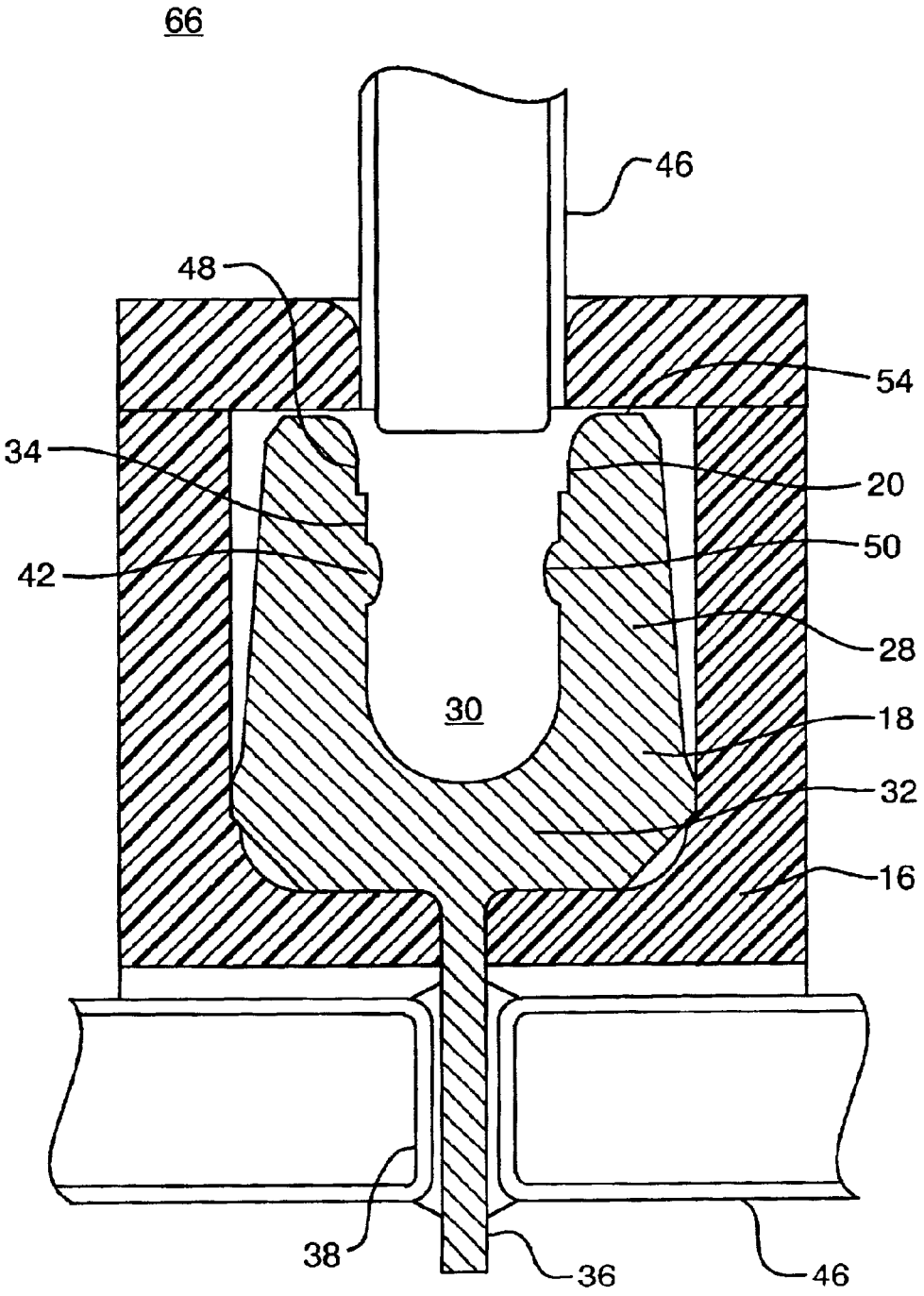
FIG. 11 is a cross-sectional image of another embodiment of this invention, in which the connector is used as a board-to-board connector.
Figure 12:
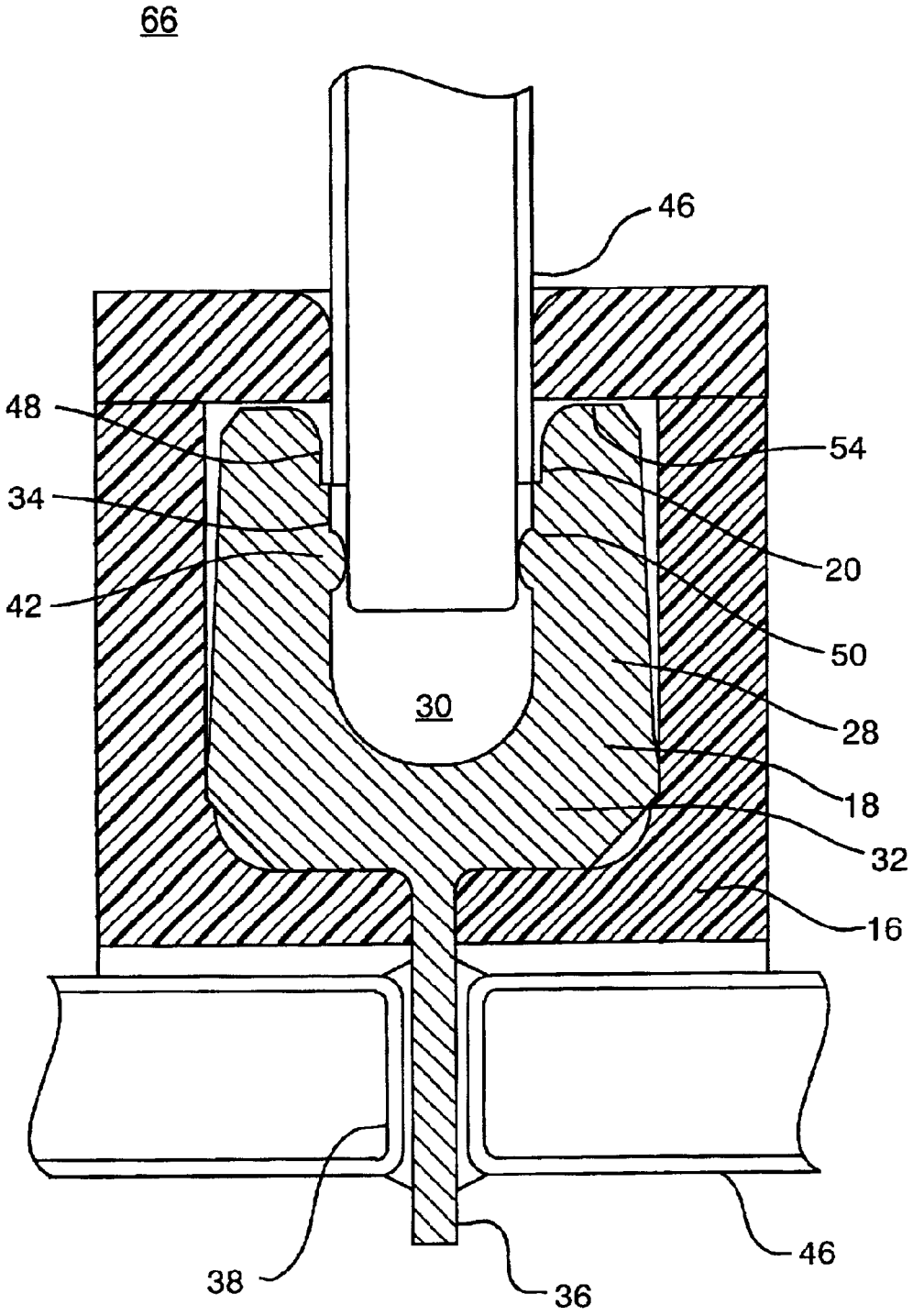
FIG. 12 is another cross-sectional image of the embodiment shown in FIG. 11, in which the connecting board is inserted into the connector.

The connector 10 could, alternatively, be built as a board-to-board connector 66, FIGS. 11 and 12. In this case, the connector 66 would not need an actuator 24. The contacts 18 would be constructed to frictionally strip insulation 22 from one circuit board 46 to connect to one or more conductors 26 on that board 46 and would also have a connection to a second board. The one circuit board 46 would be pushed into the contacts 18, similar to the actuator 24. In this way, the connector 66 would be interconnectable with one board 46 and connect to another board. The insulation 22 removed from the board 46 is analogous to the insulation 22 removed from the cable 12 in the original embodiment of the invention. A base 16 would also be required, which would at least partially contain the contacts 18.

A narrower embodiment of the board-to-board connector 66 would involve constructing the contacts 18 with two extensions 28, a crossbar 32 connecting the extensions 28 whereby the extensions 28 and crossbar 32 would be used to connect to the first circuit board 46, and a remaining portion of the contact 18 interconnectable to the second circuit board. Similar to the original connector 10, the board-to-board connector 66 could be built with contacts 18 containing force concentrators 42 as previously described.

Another embodiment of the invention 10 is an electrical connection apparatus 10 including multiple contacts 18 and a housing 68 to which the contacts 18 are secured and which is removably interlockable and reinterlockable with the multi-conductor cable 12. While the housing 68 has been described throughout the description as an actuator 24 and a base 16, the housing 68 is capable of being constructed in other ways. The inventive nature of this design does not require having an actuator 24 or base 16, but revolves around the reusability of the connector 10 and the frictional removal of insulation 22 to make contact with the conductors 26 in the cable 12.

The method 80 of making connection used by this invention is also unique. Therefore, it is another embodiment of this invention to make a connection with multi-conductor cable 12 using this disclosed method 80. The first step is pressing 82 the cable 12 against at least one contact 18. Then this method 80 requires sliding 84 the cable 12 against the contact 18 at least once and in at least one direction substantially parallel to the length of the cable 12, such that the frictional force at least partially removes the insulation 22 from the the multiple conductors' width surface 15. The final step is maintaining 86 contact between the cable 12 and the contact 18, thereby allowing electrical current to flow between the contact 18 and at least one of the conductors 26.

This inventive method 80 may further include the steps of aligning 88 the cable 12 with a connector base 16, inserting 90 an actuator 24 into the base 16 wherein the multi-conductor cable 12 is pressed against the muliple contacts 18 so as to displace the insulation 22 from the multiple conductors 26 on the width surface 15. An additional step would be interlocking 92 the actuator 24 with the base 16 at the point of full engagement to maintain electrical contact between the conductor 26 on the width surface 15 and the contact 18.

This inventive method 80 may further include wrapping 94 the multi-conductor cable 12 around the barrel 44 of the actuator 24 and holding it tightly against the barrel 44 with the contacts 18 such that the cable 12 is strain relieved.

This invention may also be provided as a terminated cable assembly 70. The assembly 70 includes a base 16, an actuator 24, and a multi-conductor cable 12 sandwiched between the base 16 and the actuator 24. The assembly 70 should further include multiple contacts 18 located at least partially within the base 16, wherein the conductors 26 are held in electrical contact against the contacts 18 by the actuator 24 in an area of the conductors 26 where insulation 22 on the width surface 15 of the conductors 26 has been partially displaced by the contacts 18.

We claim:

1. An electrical connection method for connecting multi-conductor cable having multiple conductors wherein each conductor is substantially surrounded by insulation, said multi-conductor cable being cable from the group of flat flexible cable, laminated printed circuits, encapsulated round wire ribbon cable, and cables with multiple conductors, said connection method comprising the steps of:

providing a connection base with multiple contacts, said contacts located at least partially within the base and having at least one extension;

pressing the multi-conductor cable into the base with an actuator;

cutting and removing the insulation from a surface of each of the conductors in the cable with an insulation-displacing surface located on at least one extension;

limiting a depth the insulation-displacing surface cuts into the cable with a depth limiter thereby preventing the insulation-displacing surface from damaging the conductors; and interlocking the actuator with the base, thereby engaging the multi-conductor cable with the multiple contacts.

2. The electrical connection method of claim 1 wherein each of the contacts has two extensions extruding in at least a partially similar direction.

3. The electrical connection method of claim 1 wherein at least one extension has at least one bump and the step of pressing the cable into the base further comprises pressing the cable against the at least one bump, thereby moving the extension in a direction away from the actuator and applying electrical contact force between the conductor and the bump.

4. The electrical connection method of claim 3 wherein the at least one extension contains a plurality of bumps and the method further comprises the step of wiping away adhesive and oxidation from the conductor with a first bump whereby remaining bumps make contact with the conductor ((s)).

5. The electrical connection method of claim 3 wherein the step of limiting the depth the insulation-displacing surface cuts further comprises moving the insulation-displacing surface out of the multi-conductor cable insulation by deflecting the extension when at least one of the bumps contacts the conductor.

6. The electrical connection method of claim 1 further comprising the step of preventing electrical contact between the multiple contacts with at least one insulating divider each located between a pair of contacts.

7. The electrical connection method of claim 6 further comprising the step of using the insulating dividers to position the contacts at intervals to correspond to a conductor spacing of the multi-conductor cable.

8. The electrical connection method of claim 6 further comprising bonding the insulating dividers to the contacts to create a laminated contact structure.

9. The electrical connection method of claim 1 further comprising collecting removed insulation in a neck area of the actuator.

10. The electrical connection method of claim 1 wherein the step of interlocking the actuator with the base is performed by slideably interlocking the actuator and the base.

11. The electrical connection method of claim 1 further comprising verifying cable alignment with a plurality of visual alignment notches before and after interlocking the actuator with the base.

12. The electrical connection method of claim 1 further comprising wrapping the cable around a barrel of the actuator, wherein a chamfered tip is adjacent to the depth limiter at an end of the extension of at least one of the contacts.

13. The electrical connection method of claim 12 wherein the barrel is made from a material compressible within a range of force that can be applied by the contacts thereby compensating for a thickness of the cable.

14. The electrical connection method of claim 12 wherein the actuator further comprises a barrel with a tapered leading edge for allowing the contacts to gradually align to the multi-conductor cable.

15. The electrical connection method of claim 1 wherein the actuator interlocks with the base in a plurality of positions, wherein one of the positions leaves a sufficient gap between the actuator and base to allow the multi-conductor cable to be slideably inserted between the actuator and the base.

16. The electrical connection method of claim 1 wherein the insulation-displacing surface protrudes from the extension thereby forming a cutting edge.

17. The electrical connection method of claim 1 wherein an entry side of the base substantially conforms in shape to the actuator and is chamfered whereby the multi-conductor cable wraps around the actuator when the actuator is interlocked with the base.

* * * * *